US011618976B2

(12) United States Patent
Hedhammar et al.

(10) Patent No.: US 11,618,976 B2
(45) Date of Patent: Apr. 4, 2023

(54) METHOD AND DEVICE FOR PROTEIN FIBER PRODUCTION

(71) Applicant: SPIBER TECHNOLOGIES AB, Stockholm (SE)

(72) Inventors: My Hedhammar, Stockholm (SE); Mathias Kvick, Solna (SE); Fredrik Lundell, Österskär (SE)

(73) Assignee: SPIBER TECHNOLOGIES AB

( * ) Notice: Subject to any disclaimer, the term of this patent is extended or adjusted under 35 U.S.C. 154(b) by 249 days.

(21) Appl. No.: 16/651,232

(22) PCT Filed: Oct. 9, 2018

(86) PCT No.: PCT/EP2018/077522
§ 371 (c)(1),
(2) Date: Mar. 26, 2020

(87) PCT Pub. No.: WO2019/072876
PCT Pub. Date: Apr. 18, 2019

(65) Prior Publication Data

US 2020/0308727 A1 Oct. 1, 2020

(30) Foreign Application Priority Data

Oct. 9, 2017 (EP) ..... 17195484

(51) Int. Cl.
*D01D 13/00* (2006.01)
*D01D 13/02* (2006.01)
(Continued)

(52) U.S. Cl.
CPC ..... *D01D 5/40* (2013.01); *D01F 4/00* (2013.01); *D10B 2211/20* (2013.01)

(58) Field of Classification Search
CPC ..... D01D 5/40; D01D 13/00; D01D 13/02; D01F 4/00; D10B 2211/20
(Continued)

(56) References Cited

U.S. PATENT DOCUMENTS 8,551,378 B2 * 10/2013 Velev ..... D01D 5/40 264/211.1
2010/0247908 A1 9/2010 Velev et al.
(Continued)

FOREIGN PATENT DOCUMENTS

CN 104393337 A 3/2015

OTHER PUBLICATIONS

Extended European Search Report for European Patent Application No. 17195484.5, dated Apr. 11, 2018.
(Continued)

*Primary Examiner* — Leo B Tentoni
(74) *Attorney, Agent, or Firm* — Lathrop GPM LLP; James H. Velema, Esq.; Ricardo Ochoa, Esq.

(57) ABSTRACT

A method for producing a protein polymer fiber, the method comprising providing a liquid protein solution in a container for liquid, and repeatedly moving the liquid surface in the container back and forth between a first and a second position. Said movement of the liquid surface is such that the protein polymer solution is allowed to form a film in the interface between the liquid surface of the liquid protein solution and a surrounding fluid. The movement of the liquid surface being performed by respectively raising and lowering the liquid surface relative to the container or by moving an object extending through the liquid surface of the liquid protein solution. Also, a device for performing said method.

22 Claims, 3 Drawing Sheets

(51) Int. Cl.
*D01D 5/40* (2006.01)
*D01F 4/00* (2006.01)

(58) Field of Classification Search
USPC ..... 264/164, 165, 298, 310; 425/425, 447
See application file for complete search history.

(56) References Cited

U.S. PATENT DOCUMENTS

2012/0244143 A1 9/2012 Lo et al.
2015/0291674 A1 10/2015 Hedhammar et al.

OTHER PUBLICATIONS

International Search Report and Written Opinion for PCT International Patent Application No. PCT/EP2018/077522, dated Dec. 10, 2018.
Negishi et al., "The Production of Fibers an Films from Solubilized Hagfish Slime Thread Proteins", Biomacromoledules, 2012, 13(11): 3475-3482.

* cited by examiner

METHOD AND DEVICE FOR PROTEIN FIBER PRODUCTION

RELATED APPLICATIONS

This application is a 35 U.S.C. § 371 filing of International Patent Application No. PCT/EP2018/077522, filed Oct. 9, 2018, which claims priority to European Patent Application No. 17195484.5, filed Oct. 9, 2017, the entire disclosures of which are hereby incorporated herein by reference.

TECHNICAL FIELD

The present invention relates to production of protein fiber structures. Protein fiber structures as such are known from nature, for example in the form of spider silk of spider webs and spider cocoons.

Specifically, the present invention relates to artificial production of spider silk fibers which can be formed together with sensitive molecules and cells.

BACKGROUND

Naturally produced spider silk is a material with interesting physical properties. For example, spider silk fibers provide an excellent combination of elasticity, toughness and tensile strength.

Different types of silk are suited for different uses; Some types of fibres are used for structural support, others for constructing protective structures.

Some can absorb energy effectively, whereas others transmit vibration efficiently. In a spider, these silk types are produced in different glands; so the silk from a particular gland can be linked to its use by the spider.

A material like spider silk fiber is highly interesting for engineering or bio-engineering purposes such as production of fiber structures containing cells.

Hence, some applications of these fibers may include medical applications in which sterility and control of cleanliness is of high importance.

Thus, it would be desirable to be able to produce artificial silk fiber structures in a controlled environment.

Producing a spider silk fiber firstly requires access to adequate quantities of the silk protein. Secondly, a method of producing a fiber structure from said protein needs to be implemented.

The proteins may be produced by spiders and collected but this is a slow and cumbersome process. Another approach that does not involve farming spiders is to extract the spider silk gene and use other organisms to produce the spider silk. For example, genetically modified silkworkms, goats, and *E-coli* bacterias have been used for this purpose.

A few methods of artificially producing fibers from the spider protein exist, for example 'syringe-and-needle', 'microfluidics' and 'electrospinning'.

The 'syringe and needle'-method, is based on filling of a syringe with a liquid feedstock comprising silk proteins. The feedstock is forced through a hollow needle of the syringe wherein a fiber is formed and expelled from the syringe needle. Although very cheap and easy to assemble, fibres created using this method may need removal of water from the fibre with environmentally undesirable chemicals such as the methanol or acetone, and also may require post-stretching of the fibre.

In the 'microfluidics'-method, fiber is produced by hydrodynamic focusing of a protein solution. The focusing liquid is of low pH and will force a structural change in the protein. By adjusting the focusing parameters different physical properties of the resulting fiber can be achieved.

A drawback of this method is that the use of chemicals to induce the structural change prevents the fiber to simultaneously be formed together with sensitive molecules and cells.

In the 'electrospinning'-method, fiber is produced by injecting a stream of the solution into an electric field. The electric field between the injection needle and the collector will cause the injected solution to be divided into multiple jets, which will dry before gathering in a non-woven format at the collector.

A drawback of this method is that by using a strong electric field, producing a fibre containing sensitive molecules or cells during the fiber formation is not possible.

A specific prior art method is the one first used by Stark et al. (Macroscopic fibers self-assembled from recombinant spider silk protein, Biomacrocolecules 8(5) 2007). They use repeated wagging/rocking of a container from left to right as schematically illustrated in FIGS. 4*a-c*. The fiber structure produced is thicker to the left and right of the container shown and gradually thinner in the middle of the container. The non-uniform structure of the fiber is disadvantageous both since it gives lower strength and difficulties in performing reproducible studies. Moreover, the large volumes needed requires a lot of protein (of which some is wasted) and gives low yields of incorporation of other molecules or cells during fiber formation.

Thus, an object of the invention is to provide an improved method and a device for producing protein fiber structures not suffering from the above mentioned drawbacks.

SUMMARY

According to a first aspect, this and other objects is achieved by a method for producing a protein fiber structure, said method comprising:

providing a liquid protein solution in a container for liquid, providing an adjacent fluid interfacing the liquid surface of the liquid protein solution, for example air or a suitable gas composition, and repeatedly moving the liquid surface in the container between at least a first and a second position. Said movement of the liquid surface is such that the protein polymer solution, ie. liquid polymer solution, forms a film in the interface between the liquid surface of the liquid protein solution and the adjacent fluid. Further, the movement of the liquid surface is performed by respectively raising and lowering the liquid surface relative to the container such that the film at the interface between film and the container is exerted to stress thereby forming a fiber.

Alternatively, or complimentary to raising and lowering, the movement of the liquid surface may be performed by providing an object extending through the liquid surface and moving the object within the container such that the film at the interface between the film and the object is exerted to stress thereby forming a fiber.

By repeatedly moving the liquid protein solution between the first and second positions and moving its liquid surface such that the protein polymer solution forms a film, a fiber is gradually formed around the circumference of the liquid surface. The fiber typically sticks to the wall of the container rather than follow the liquid surface. The repeated movements of the liquid surface causes formation of cracks in the film and those cracks promote the formation of fibers.

By performing the movement of the liquid surface by raising and lowering respectively, the liquid surface relative to the container, the fiber forms uniformly thick around the circumference of the liquid surface, i.e. along the inside of the container wall. When raising and lowering the liquid surface, the liquid surface repeatedly stretches and contracts due to surface tension and adherence to the wall of the container. This tends to cause formation of folds and/or cracks of the film, which tend to lead to fiber structures moving outwards towards the wall of the container where they add to the fiber formed.

By providing an object extending through the liquid surface and moving the object within the container such that the film at the interface between the film and the object is exerted to stress thereby forming a fiber, an alternative way of stressing the film to create fibers is provided.

The movement between the first and second positions may be a back and forth movement between said positions.

The object may comprise a body with varying cross-sectional shape along a longitudinal axis of the object. The varying cross sectional shape enables easy variation of the shape of the interface between the object and the liquid solution/film by simply raising or lowering the object in the liquid protein solution. Thus, the changing interface shape leads to more efficient formation of cracks and stress affecting the film to thereby improve fiber formation.

The object may be hollow and comprise an inlet and an outlet. The inlet and outlets enables liquid and gas to enter and exit the object, thereby mitigating pressure build-up and pressure differences at raising and lowering of the object in the liquid protein solution.

The object may be conical or frustoconical. The frustoconical shape provides a circular or elliptic cross-sectional shape and thereby promotes even fiber thickness around the object.

The object may be tapering along its longitudinal axis. The cross sectional shape need not be circular or elliptic, but could be any shape which changes along the longitudinal axis of the object, wherein a change in size along the length allows for formation of fibers of different sizes depending on the depth at which the object is operated in the liquid protein solution.

The direction of movement of the object and the orientation of the object may be such that the shape of the interface between the object and the film varies at different positions of the object.

The movement of the object may comprise a rotational movement of the object. By using a rotational movement of the object, stress may be created in the film without raising or lowering the object, by simply rotating the object in the liquid protein solution. This enables stressing the film without affecting the liquid level in the container.

The liquid surface may be kept horizontal whilst raising and lowering it.

Keeping it horizontal promotes an even distribution and transport of the folds and fibrils formed, thereby promoting formation of a uniform fiber structure. It goes without saying that there is no such thing as perfectly horizontal and the meaning of horizontal thus implies a range of about +−5 degrees around the horizontal plane.

The raising or lowering of the liquid surface may be made by variation of the volume of the container below the liquid surface. Varying the volume of the container below the liquid surface makes the liquid solution rise and fall within the container whilst keeping the liquid surface horizontal, i.e. without causing formation of waves.

The volume of the container below the liquid surface may be varied by movement of a piston within said volume. Upon forcing the piston into the volume of the container below the liquid surface, said volume decreases and liquid is forced to rise within the container. Similarly, upon withdrawing the piston from within the volume of the container below the liquid surface, said volume increases and liquid is allowed to sink within the container, thereby lowering the level of the liquid surface. The use of a piston for varying the volume is simple and robust and enables use of rigid materials for all parts of the container.

As an alternative to using a piston as described above, said raising or lowering of the liquid surface is made by variation of the volume of liquid in the container, for example by respective introduction or removal of liquid from below the liquid surface. At introduction of liquid into the container from below the liquid surface of the liquid polymer solution, the liquid surface is raised within the container. Similarly, at removal of liquid into the container from below the liquid surface of the liquid polymer solution, the liquid surface is lowered within the container. This enables use of a rigid container with only an inlet means through which fluid is introducible into the liquid polymer solution. The inlet means may be any suitable means, such as a liquid passage through the container wall, or a tube extending from above the liquid surface through the liquid surface and into the liquid polymer solution where it emanates.

According to a second aspect, the objects are achieved by a device for fiber production. The device comprising a container for liquid and a first means for raising and lowering the liquid surface of a liquid in the container relative to the container whilst preferably keeping the liquid surface substantially horizontal. The device comprises a motor configured to drive said first means to repeatedly raise and lower the liquid surface relative to the container according to the method of the first aspect, such that the film at the interface between the film and the container is exerted to stress, thereby forming a fiber.

The device may comprise a container for holding a volume of liquid having a liquid surface, an object configured to extend through the liquid surface, and a motor operatively connected to the object and configured to operate the object within the container according to the method as defined in the first aspect, such that the film at the interface between the film and the object is exerted to stress, thereby forming a fiber.

The object may comprise a body with varying cross-sectional shape along a longitudinal axis of the object. Further, the object may be hollow and comprise an inlet and an outlet. Further, the object may be conical, frustoconical or tapering along its longitudinal axis.

The first means may comprise a piston configured to be movable within the container for varying its inner volume, wherein the portion of the container which defines the volume of the container below the liquid surface is cylindrical and wherein the piston is configured to seal against the inside of the cylindrical portion and be movable along the cylindrical portion for varying its inner volume.

The first means may comprise a fluid port and a pump device for pumping liquid into and out of the port, thereby controlling the liquid level within the container. The use of pumping of liquid for controlling the liquid surface level of the container omits the need of a piston. Further, the container can be filled from below and thereafter the liquid surface can be moved using the same pump as used for filling the container. After the fiber is finished, the container can be emptied using the pump.

A third aspect relates to use of a device according to the second aspect for producing a protein polymer fiber.

| | |
|---|---|
| 1 | device for fiber production |
| 2 | container for liquid |
| 3 | first means (for raising and lowering the liquid surface) |
| 4 | piston |
| 5 | portion of container defining volume below liquid surface |
| 6 | fiber/fiber structure |
| 7 | liquid protein solution |
| 8 | liquid surface |
| 9 | prior art container |
| 10 | prior art liquid surface |
| 11 | object (to be moved through liquid surface) |
| 12 | adjacent fluid |
| 13 | motor (optional) |

DETAILED DESCRIPTION

The invention will hereinafter be described in more detail with reference to the accompanying drawings. The invention may however be embodied in many different forms and should not be construed as limited to the embodiments set forth herein; rather, these embodiments are provided for thoroughness and completeness, and fully convey the scope of the present aspects to the skilled person.

Figure 3:
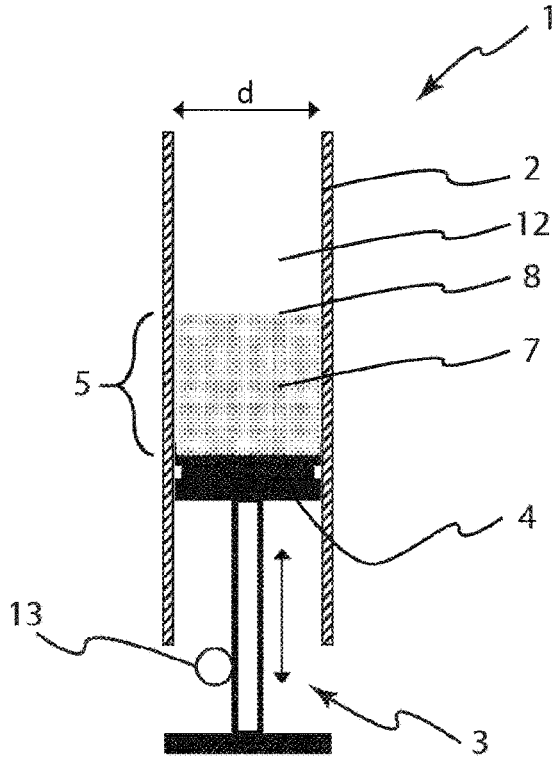
FIG. 3 shows a device for fiber production on the form of a syringe with cut-off barrel.
Figure 4A:
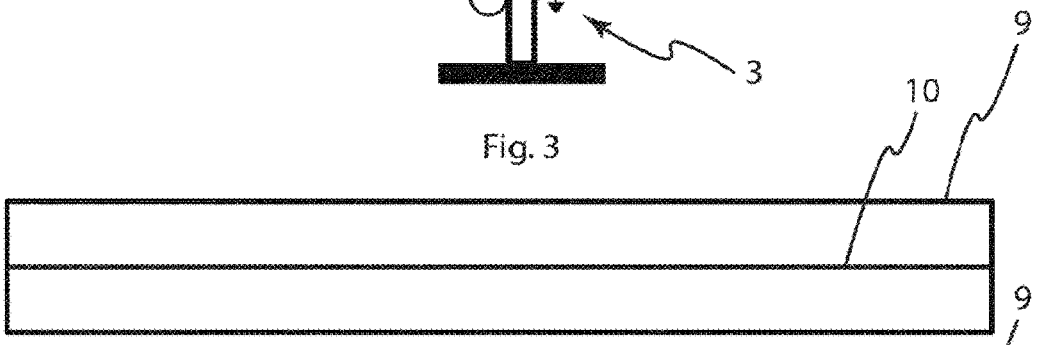
Fig. 4a PRIOR ART
FIGS. 4*a-c* show a background art device and method for producing a fiber structure. The device uses a wagging/rocking using of a tray/container creating a slushing sideways movement of the liquid polymer solution from side to side.
Figure 4B:
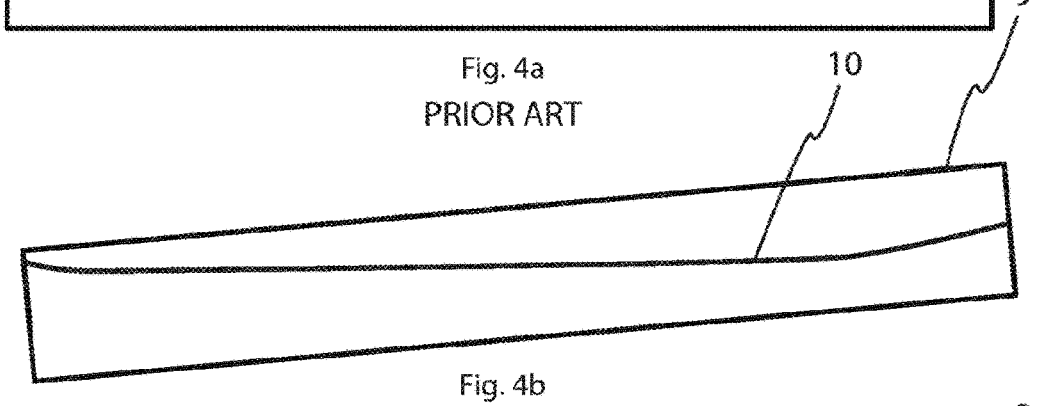
Fig. 4b PRIOR ART
Figure 4C:
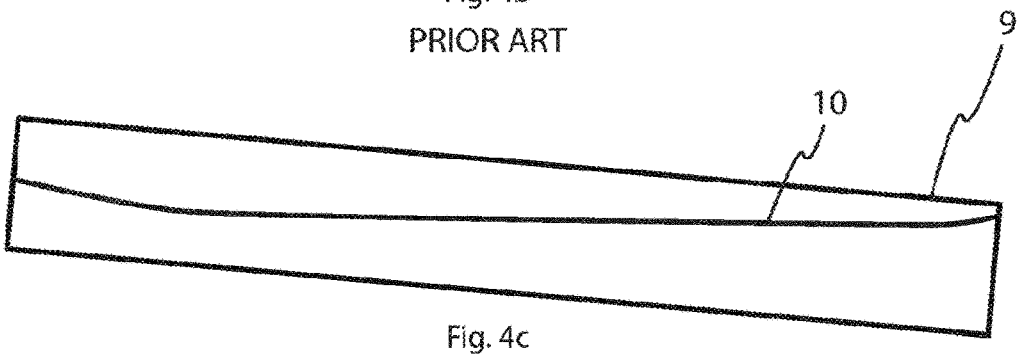
Fig. 4c PRIOR ART
Figure 5:
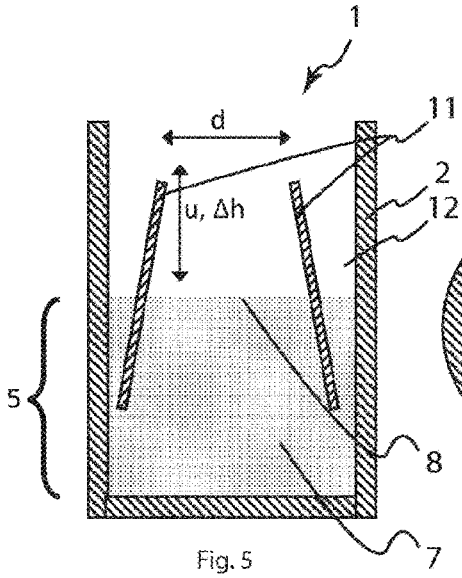
FIG. 5 shows a cross-sectional schematic view of a container and a frustoconical object to be repeatedly raised and lowered in the container.
Figure 6:
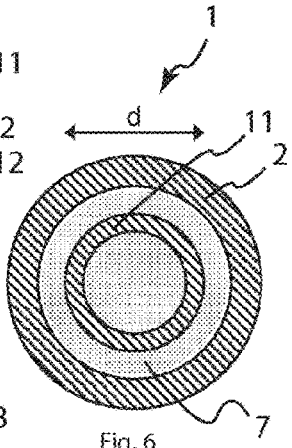
FIG. 6 shows a cross-sectional schematic view from above of a cylindrical container and a cylindrical object to be repeatedly raised and lowered in the container.
Figure 7:
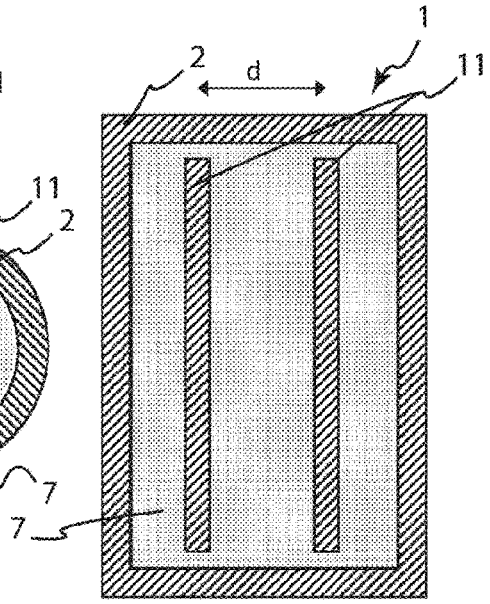
FIG. 7 shows a cross-sectional schematic view from above of a rectangular container and an object comprising two rectangular plates to be repeatedly raised and lowered in the container.
Figure 8:
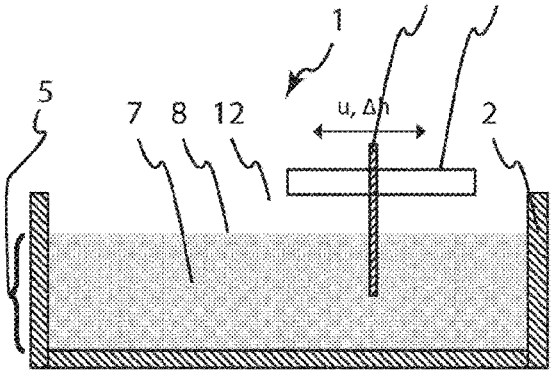
FIGS. 8-9 show a cross sectional schematic side view and top view respectively, of a container and a plate shaped object to be repeatedly moved sideways back and forth through the liquid surface in the container.
Figure 9:
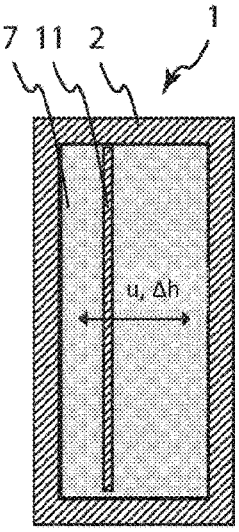
Figure 10:
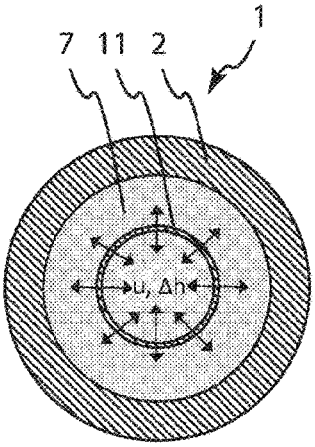
FIG. 10 shows a cross sectional schematic view from above of a cylindrical container in which a cylindrical object is repeatedly moved sideways back and forth in different directions through the liquid surface in the container.

A device 1 according to a first embodiment of the invention is shown in FIG. 3. The device 1 is suitable for fiber production and comprises a container 2 for liquid and a first means 3 for respectively raising and lowering the liquid surface of a liquid in the container 2 relative to the container 2 whilst keeping the liquid surface substantially horizontal. The first means 3 comprises a piston 4 configured to be movable within the container 2 for varying its 2 inner volume. The portion 5 of the container which defines the volume of the container 2 below the liquid surface is cylindrical and the piston 4 configured to seal against the inside of the cylindrical portion and be movable along the cylindrical portion. The container 2 is in this embodiment the barrel of a syringe and the piston 4 the plunger of the syringe. However, in other embodiments, the container 2 could be some other type of suitable container, such as a pipe or extruded profile or a plate with at least one hole drilled to form a space for containing a liquid. Also, the plunger could be replaced with any other type of piston adapted for working in the container. Alternatively, the piston could be exchanged for a resilient membrane allowing variation of the volume of the container by elastically deforming the membrane.

The device 1 may be operated manually to form the fiber 6 (see FIGS. 1*a-f*). However, in an embodiment, the device 1 comprises a fixture (not shown in the figures) for attachment of the container/syringe and a drive means configured to automatically operate the piston or membrane 4.

The drive means comprises an electric motor 13 and a power transmission means for converting the rotational movement of the electrical motor into movement of the piston 4 for controlling its position relative to the container 2. The power transmission means may be a power screw operatively connected to an operating arm attachable to the piston/plunger of the syringe. In other embodiments a hydraulic transmission may be used wherein a fluid is used for driving the piston or for deforming the membrane.

In an alternative embodiment, the raising or lowering of the liquid surface is made by variation of the volume of liquid in the container 2 instead of varying the volume of the container 2 as described above. In this alternative embodiment (not shown in figures), the first means 3 comprises a fluid port and a pump device for pumping liquid into and out of the port, thereby controlling the liquid level within the container 2.

The use of an electrical drive means tends to provide improved control of the fiber production and allows for continuous production. The use of pumping of liquid for controlling the liquid surface level of the container omits the need of a piston. Further, the container can be filled from below and thereafter the liquid surface can be moved using the same pump as used for filling the container. After the fiber is finished, the container can be emptied using the pump.

In an embodiment, a system may be provided comprising several of the above-described devices using variation of liquid volume in the container. In the system multiple containers are connected to one pump. Such a system can control the liquid level of multiple containers simultaneously using only one pump, thereby reducing the complexity of the system and the power usage of the system. The use of a single pump also provides for more even pumping than using multiple pumps.

Figures 2A, 2B, 2C, 2D, 2E:
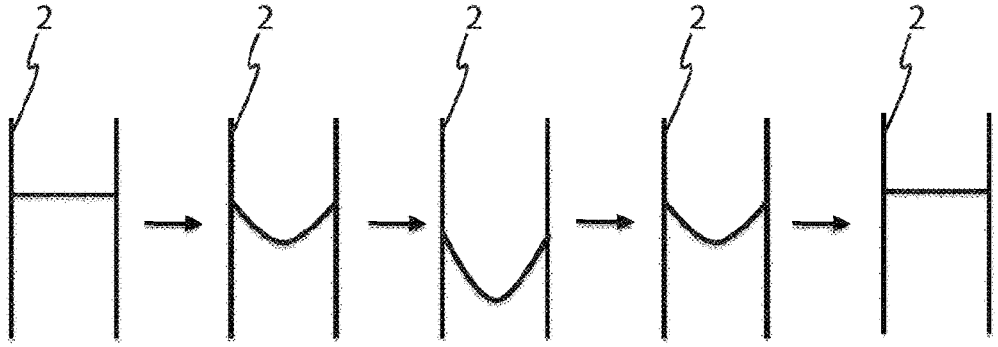
FIGS. 2*a-e* show schematically a cycle of moving the liquid surface in the container back and forth between a first (FIG. 2*a*) and a second position (FIG. 2*c*) by raising and lowering. The amount of deflection of the liquid surface is exaggerated for illustrative purposes.

The above described devices 1 are operated using the following method. First, a liquid protein solution 7 is provided in the container 2 for liquid. Thereafter, the liquid surface 8 in the container is repeatedly moved back and forth between a first (FIG. 2*a*) and a second (FIG. 2*c*) position. Said movement of the liquid surface is such that the protein polymer solution forms a film in the interface between the liquid surface of the liquid protein solution and a surrounding fluid. The movement of the liquid surface is performed by respectively raising and lowering the liquid surface relative to the container. Preferably whilst keeping the liquid surface substantially horizontal.

By repeatedly moving the liquid protein solution back and forth between the first and second positions and moving its liquid surface such that the protein polymer solution forms a film, a fiber is gradually formed around the circumference of the liquid surface. The fiber typically sticks to the wall of the container rather than follow the liquid surface. The repeated movements of the liquid surface causes formation of cracks in the film and those cracks promote the formation of fibers. By performing the movement of the liquid surface by raising and lowering respectively the liquid surface relative to the container, the fiber forms uniformly thick around the circumference of the liquid surface, i.e. along the inside of the container wall. When raising and lowering the liquid surface, the liquid surface repeatedly stretches and contracts due to surface tension and adherence to the wall of the container. This tends to cause formation of folds and/or cracks of the film, which tend to lead to fiber structures moving outwards towards the wall of the container where they add to the fiber formed. The movement of the liquid surface such that the protein solution forms a film can be done in numerous movement patterns whilst achieving the film formation, depending on the circumstances, such as the surface tension, temperatures, viscosity etc. For example, such movement may be made at constant speed up and down. Also, the movement could be interrupted one or more times during a repetition, for example at an upper liquid surface position, a lower liquid surface position, or in-between. Further, the speed of movement of the liquid surface could be varied throughout the movement, wherein a slower movement typically promotes said film formation. Thus, at least a portion of said movement of the liquid surface may be performed slow enough or at long enough periods between repetitions for the protein polymer solution to form a film, thereby achieving said film formation.

As an alternative to raising and lowering the liquid surface, the movement of the liquid surface may be performed by providing an object extending through the liquid surface and moving the object within the container such that the film at the interface between the film and the object is exerted to stress thereby forming a fiber. Here, the stress, for example caused by shear forces, expansion or compression forces in the film, leads to cracks in the film, which leads to formation of fibers around the object.

In other words, a silk protein solution, such as a spider silk protein solution, diluted to its desired concentration, is transferred to a syringe which has had its top cut in order to create an open space (see FIG. 3). If a closed syringe was used the humidity at the liquid-air interface and the syringe wall would increase, resulting in less robust fiber formation. The syringe with the liquid protein solution is placed vertically oriented in a syringe pump. The pump is configured to create a vertical oscillatory motion of the syringe piston, and thereby also of the liquid solution. Once the solution has been placed in the syringe, protein start to gather at the liquid-air interface and after some time (typically minutes) a protein film will develop at the interface between liquid and air, similar to the skin formed on heated milk. It is from this protein film that the fibers will form. During the vertical oscillation, i.e. raising and lowering of the liquid surface relative to the container, the film that has formed at the interface will to some degree stick to the wall of the syringe, causing the film to extend during the downward portion of the oscillation. In the following upward motion, the film will therefore be compressed in relation to its extended state. If a thin film is compressed it will start to wrinkle, and if the compression is large enough some of these wrinkles will develop into folds. Wrinkles can be viewed under a microscope, while folds can be seen by the naked eye during experiments. At subsequent oscillations, the folds will become inherent weak points of the film, and the folds will continue to appear at approximately the same position. In experiments it is observed that as more and more oscillations occur, the folds will slowly move towards the wall of the syringe barrel, often in a non-symmetric fashion, i.e. the point from which the folds are moving out from is not the center of the film surface. Also, the location is not static from oscillation to oscillation or production batch to production batch. Continued oscillation leads to part of the film breaking of to form fibrils eventually gathering at the inside of the syringe barrel. These fibrils tend to get stuck on the wall at the liquid's maximum position. In some cases, the film can be seen to break in its interior when it is close to its lowest position, while the process continues the gap formed by this break will be healed by freshly formed film. However, more often these film breakups cannot be seen, and the folds are travelling towards the wall due to a non-homogeneous extension of the film. How the film breaks at the wall, and how this film extension looks like is still unknown and currently under investigation. As the process continues, more and more fibrils will gather on the wall at the maximum liquid level, these fibrils will together form the fiber structure. In the following table, some tested parameters are presented. These are for a syringe with an inner diameter of 12-14 mm and are not to be construed as limiting for the scope of the invention.

| Symbol | Parameter | Variation |
|---|---|---|
| Δh | Oscillating height | 3, 7, 10 mm |
| Δt | Oscillating period | 8, 14, 20 s |
| T | Temperature | 21-26° C. |
| RH | Relative humidity | 25-60% |
| μ | Viscosity | |
| ρ | Surface Tension | |
| c | Protein concentration | 0.1-1 mg/mL |
| A | Area of container | 120-201 $mm^2$ |
| V | Volume of solution | 1-1.5 mL |
| | Protein | QG, FN |
| | Buffer | Tris, DMEM, PBS |

However, the suitable speed and oscillating period should be adapted to the other parameters. If a polymer solution forms film faster, a shorter interval can be used and vice versa.

FIGS. 1*a-f* schematically show how the polymer film at the surface of the liquid polymer solution stretches, folds, and cracks, where after material is gradually moved towards the inside of the wall of the container and accumulates along the inside of the wall of the container to form a fiber structure.

It should be understood that FIGS. 1*a-f* show cut-away views of the container in cross-section with only one wall portion of the container shown. Hence, the gradual movement of cracks and fibrils/fibers is illustrated by the folds/fibrils/fibers moving from the right in each respective figure, towards the left of the figure, i.e. towards the inside of the wall of the container, as indicated by the straight arrows.

Figures 1A, 1B, 1C:
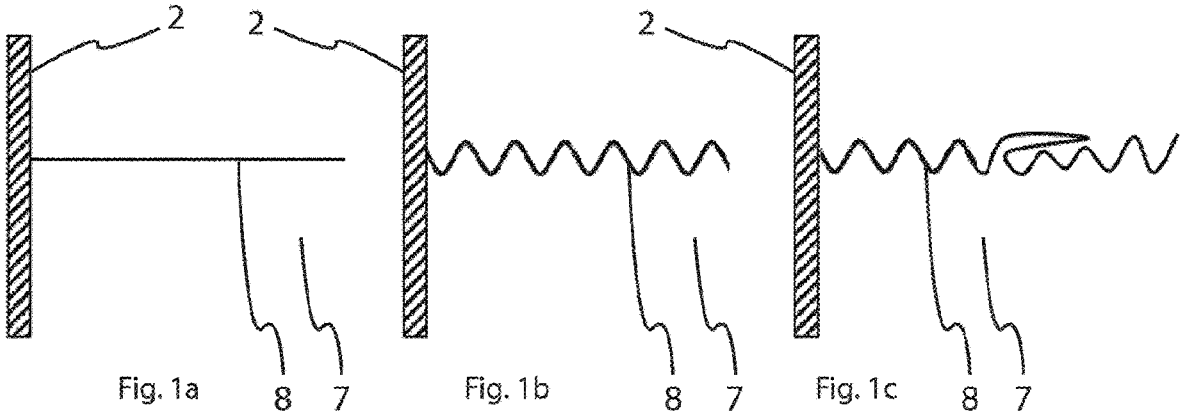
FIGS. 1*a-f* show schematically how stretched film gradually forms a fiber structure along the inside of the container wall.
Figures 1D, 1E, 1F:
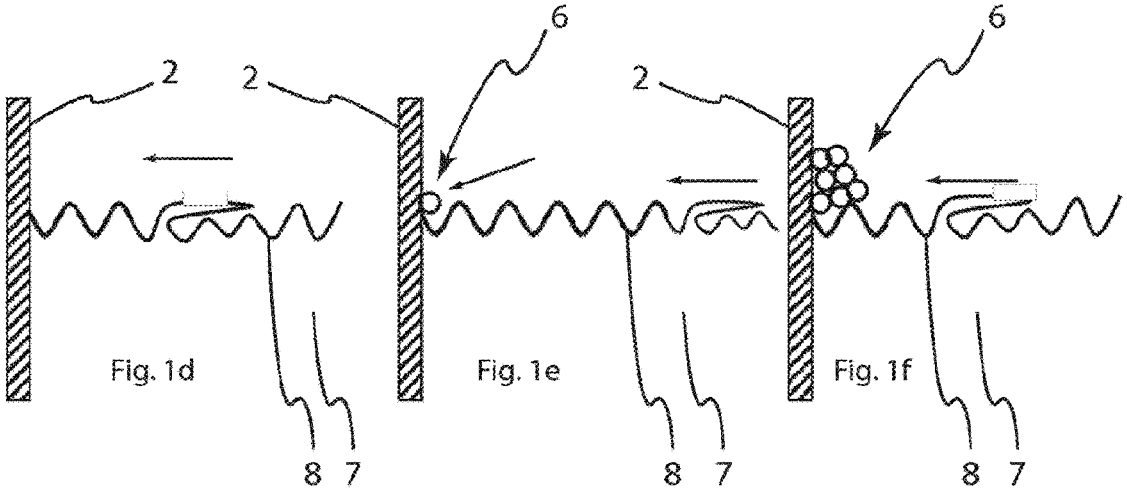

In FIG. 1*a*, the film is formed but not stretched. In FIG. 1*b*, the film has been stretched—as schematically illustrated by the 'wave shape'. However, the real film is not wave shaped, but stretched substantially horizontally such as bulging. FIG. 1*c* illustrates that excess film folds over. FIG. 1*d* illustrates that the folded over film eventually cracks. FIG. 1*e* shows that a fibril or piece of loose film material of a fold has moved outwards to the inside of the wall of the container whilst another fold has been created further into the container, i.e. further to the right in the figure. FIG. 1*f* similarly shows that even more fibrils or pieces of film material have accumulated along the inside of the wall of the container.

FIGS. 2*a-e* show schematically a cycle of movement of the liquid surface performed by respectively raising and lowering (raised in FIG. 2*a*, lowered in FIG. 2*c* and again raised in FIG. 2*e*) the liquid surface relative to the container whilst keeping the liquid surface substantially horizontal. Substantially horizontal does not mean that the surface is planar but implies that the surface is not forming substantial or breaking waves within the container. However, the surface is still to be considered horizontal despite some bulging of the surface up and down caused by surface tension and adherence to the container walls.

In all above-mentioned embodiments of the invention, sensitive molecules and cells may be incorporated into the liquid protein solution without being damages during production of the fiber structure. The inventive method uses no chemicals or strong electric field harmful for such sensitive molecules and cells and can therefore be used to produce fiber structures containing such sensitive molecules and cells.

ITEMIZED LIST OF SOME EMBODIMENTS

I. Method for producing a protein polymer fiber, the method comprising:

providing a liquid protein solution in a container for liquid, and repeatedly moving the liquid surface in the container back and forth between a first and a second position, wherein said movement of the liquid surface is such that the protein polymer solution forms a film in the interface between the liquid surface of the liquid protein solution and a surrounding fluid, characterized by the movement of the liquid surface being performed by respectively raising and lowering the liquid surface relative to the container.

II. Method according to embodiment I, wherein the raising and lowering of the liquid surface is performed whilst keeping the liquid surface substantially horizontal.

III. Method according to any one of embodiments I-II, wherein said raising or lowering of the liquid surface is made by variation of the volume of the container below the liquid surface.

IV. Method according to embodiment III, wherein the volume of the container below the liquid surface is varied by movement of a piston within said volume.

V. A method according to any one of embodiments I-II, wherein said raising or lowering of the liquid surface is made by variation of the volume of liquid in the container, for example by respective introduction or removal of liquid from below the liquid surface.

VI. Device for fiber production, said device comprising a container for liquid and a first means for raising and lowering the liquid surface of a liquid in the container relative to the container whilst preferably keeping the liquid surface substantially horizontal, wherein said device is configured to operate according to the method of any one of embodiments I-V.

VII. Device according to embodiment VI, wherein the first means comprises a piston configured to be movable within the container for varying its inner volume.

VIII. Device according to embodiment VII, wherein the portion of the container which defines the volume of the container below the liquid surface is cylindrical and wherein the piston is configured to seal against the inside of the cylindrical portion and be movable along the cylindrical portion for varying its inner volume.

IX. Device according to embodiment VIII, wherein the container is the barrel of a syringe and wherein the piston is the plunger of the syringe.

X. Device according to any one of claims embodiments VIII-IX, further comprising a fixture for attachment of the container and a drive means configured to automatically operate the piston.

XI. Device according embodiment X, wherein the drive means comprises an electric motor and a power transmission means for converting the rotational movement of the electrical motor into movement of the piston for controlling its position relative to the container.

XII. Device according to embodiment VI dependent on embodiment V, wherein the first means comprises a fluid port and a pump device for pumping liquid into and out of the port, thereby controlling the liquid level within the container.

XIII. System comprising several devices according to embodiment XII, wherein multiple containers are connected to one pump.

XIV. Use of a device according to any one of embodiments VI-XII or a system according to embodiment XIII for producing a protein polymer fiber.

The invention claimed is:

1. A method for producing a protein polymer fiber, the method comprising:

providing a liquid protein solution (7) in a container (2) for liquid, providing an adjacent fluid (12) interfacing the liquid surface (8) of the liquid protein solution (7), and repeatedly moving the liquid surface (8) in the container (2) between at least a first and a second position, wherein said movement of the liquid surface (8) is such that the protein polymer solution (7) forms a film in the interface between the liquid surface (8) of the liquid protein solution (7) and the adjacent fluid (12), characterized by the movement of the liquid surface (8) being performed by respectively raising and lowering the liquid surface (8) relative to the container (2) such that the film at the interface between the film and the container (2) is exerted to stress thereby forming a fiber, or by the movement of the liquid surface (8) being performed by providing an object (11) extending through the liquid surface (8) and moving the object (11) within the container (2) such that the film at the interface between the liquid, air and the object (11) itself, is exerted to stress thereby forming a fiber.

2. The method according to claim 1, wherein the movement between the first and second positions is a back and forth movement between said positions.

3. The method according to any one of claims 1-2, wherein the object (11) comprises a body with varying cross-sectional shape along a longitudinal axis of the object (11).

4. The method according to claim 3, wherein the object (11) is hollow and comprises an inlet and an outlet.

5. The method according to claim 4, wherein the object (11) is conical or frustoconical.

6. The method according to claim 4, wherein the object (11) is tapering along its longitudinal axis.

7. The method according to claim 1, wherein the direction of movement of the object (11) and the orientation of the object (11) is such that the shape of the interface between the object (11) and the film varies at different positions of the object.

8. The method according to claim 1, wherein the movement of the object (11) comprises a rotational movement of the object (11).

9. The method according to claim 1, wherein the raising and lowering of the liquid surface (8) is performed whilst keeping the liquid surface (8) horizontal.

10. The method according to claim 1, wherein said raising or lowering of the liquid surface (8) is made by variation of the volume of the container (2) below the liquid surface (8).

11. The method according to claim 10, wherein the volume of the container (2) below the liquid surface (8) is varied by movement of a piston (4) within said volume.

12. The method according to claim 1, wherein said raising or lowering of the liquid surface (8) is made by variation of the volume of liquid in the container (2).

13. A device (1) for fiber production, said device comprising a container (2) for liquid and a first means (4) for raising and lowering the liquid surface (8) of a liquid (7) in the container (2) relative to the container (2), wherein said device (1) comprises a motor (13) configured to drive said first means to repeatedly raise and lower the liquid surface relative to the container according to the method defined in claim 1, such that the film at the interface between the liquid, air and the container itself, is exerted to stress, thereby forming a fiber.

14. A device for fiber production, said device comprising a container for holding a volume of liquid having a liquid surface, an object configured to extend through the liquid surface, and a motor (13) operatively connected to the object and configured to operate the object within the container according to the method as defined in claim 1, such that the film, at the interface between the liquid, air and the object itself, is exerted to stress, thereby forming a fiber.

15. The device according to claim 14, wherein the object comprises a body with varying cross-sectional shape along a longitudinal axis of the object.

16. The device according to claim 15, wherein the object is hollow and comprises an inlet and an outlet.

17. The device according to claim 16 wherein the object is conical, frustoconical or tapering along its longitudinal axis.

18. The device according to claim 13, wherein the first means comprises a piston configured to be movable within the container for varying its inner volume, wherein the portion of the container which defines the volume of the container below the liquid surface is cylindrical and wherein the piston is configured to seal against the inside of the cylindrical portion and be movable along the cylindrical portion for varying its inner volume.

19. The device according to claim 13, wherein the first means comprises a fluid port and a pump device for pumping liquid into and out of the port, thereby controlling the liquid level within the container.

20. The method according to claim 1, wherein the adjacent fluid (12) is one of: air and a suitable gas composition.

21. The method according to claim 12, wherein variation of the volume of liquid in the container (2) is performed by one of: introduction and removal of liquid from below the liquid surface (8).

22. The device according to claim 13, wherein the first means (4) is further for raising and lowering the liquid surface (8) of a liquid (7) in the container (2) relative to the container (2) whilst keeping the liquid surface (8) substantially horizontal.

* * * * *